US005104566A

United States Patent [19]

Guerin et al.

[11] Patent Number: 5,104,566

[45] Date of Patent: Apr. 14, 1992

[54] STABLE ZEOLITE/SUCCINOGLYCAN SUSPENSIONS

[75] Inventors: Gilles Guerin, Eaubonne; Magali Knipper, Paris, both of France

[73] Assignee: Rhone-Poulenc Chimie, Courbevoie, France

[21] Appl. No.: 594,561

[22] Filed: Oct. 9, 1990

[30] Foreign Application Priority Data

Oct. 9, 1989 [FR] France ..... 89 13139

[51] Int. Cl.[5] ..... C11D 3/12; C11D 3/37

[52] U.S. Cl. ..... 252/174.17; 252/89.1; 252/174.15; 252/174.25

[58] Field of Search ..... 252/174.25, 174.23, 252/174.17

[56] References Cited

FOREIGN PATENT DOCUMENTS 0040445 11/1091 European Pat. Off. .

*Primary Examiner*—Asok Pal
*Assistant Examiner*—P. Achutamurthy
*Attorney, Agent, or Firm*—Burns, Doane, Swecker & Mathis

[57] ABSTRACT

Stable suspensions of zeolite particulates, in water, well adapted for detergency applications, include an effective stabilizing amount of a succinoglycan and, advantageously, a dispersing agent, e.g., a silicone resin or a siliconate and/or siliconate derivative.

39 Claims, No Drawings

STABLE ZEOLITE/SUCCINOGLYCAN SUSPENSIONS

CROSS-REFERENCE TO COMPANION APPLICATIONS

Copending applications Ser. No. 598,961 and Ser. No. 594,558, now U.S. Pat. No. 4,064,562, both filed concurrently herewith and both assigned to the assignee hereof.

BACKGROUND OF THE INVENTION

1. Field of the Invention

The present invention relates to novel stable zeolite/-succinoglycan suspensions and to the use of such novel suspensions for detergency applications.

2. Description of the Prior Art

The use of zeolites in detergent compositions is well known to this art. Thus, the zeolites have at least partially replaced the phosphates in detergents. Indeed, the phosphates are believed to be responsible for the eutrophication of water supplies and thus of presenting ecological and environmental difficulties.

The zeolites are generally used in the form of aqueous suspensions or slurries which, for example, can be introduced into detergent slurries which can then be sprayed.

However, these zeolite suspensions have a tendency to sediment or to gel, which makes them difficult to transport or store. In fact, the deposition of a hard layer of pigment covered by a slurry which is more fluid, but poor in solids content is very frequently observed at the end of transport, or after a more or less prolonged period of storage.

Moreover, it is typically impossible to resuspend the zeolite, or to provide a slurry having a sufficiently low viscosity as to be pumpable and therefore industrially. useful.

SUMMARY OF THE INVENTION

Accordingly, a major object of the present invention is the provision of novel, stable aqueous zeolite suspensions, which novel suspensions do not sediment or sediment only very slightly after storing for several days.

Another object of the present invention is the provision of novel zeolite suspensions which are not only stable over time and in storage, but which, moreover, are also pumpable, namely, they have such low viscosities as to be suitable for industrial use.

Briefly, the present invention features novel stable suspensions of the zeolites, in water, such novel zeolite suspensions also comprising a succinoglycan stabilizer.

DETAILED DESCRIPTION OF THE PREFERRED EMBODIMENTS OF THE INVENTION

More particularly according to the present invention, in a preferred embodiment thereof, the subject aqueous suspensions of zeolites also contain a dispersing agent comprising a siliconate and/or a siliconate derivative.

In another preferred embodiment of the invention, the subject aqueous suspensions of zeolites also contain a dispersing agent comprising a silicone resin.

Suitable zeolites for the formulation of the suspensions of the present invention comprise the naturally occurring or synthetic crystalline, amorphous and mixed crystalline/amorphous zeolites.

Of course, those capable of reacting sufficiently rapidly with calcium and/or magnesium ions such as to soften washing waters are the preferred.

Typically, finely divided zeolites are used which have an average primary particle diameter ranging from 0.1 to 10 μm and advantageously from 0.5 to 5 μm, as well as a theoretical cation exchange capacity in excess of 100 mg of $CaCO_3$/g of anhydrous product and preferably of more than 200 mg.

The zeolites of the A, X or Y type, and in particular 4A and 13X, are the preferred.

The product described in French patent applications Nos. 2,225,568, 2,269,575 and 2,283,220, hereby expressly incorporated by reference, are exemplary zeolites that can be used to formulate the novel suspensions of the present invention.

The zeolites prepared by the processes described in French Patent Applications Nos. 2,376,074, 2,384,716, 2,392,932 and 2,528,722, assigned to the assignee hereof and hereby also expressly incorporated by reference, are particularly preferred. The '722 application in particular describes zeolites having a rate constant, related to the surface area of the zeolites per liter of solution, of more than 0.15 $s^{-1}.1.m^{-2}$, preferably more than 0.25 and which advantageously ranges from 0.4 to 4 $s^{-1}.1.m^{-2}$. These zeolites have particularly desirable properties in detergency applications.

The aforenoted '932 application, in particular, describes zeolites prepared by a process entailing injecting an aqueous solution of sodium silicate into the axis of a venturi, while an aqueous solution of sodium aluminate is injected coaxially into the same venturi, with recycling of the resulting mixture.

In particular, zeolites of the formula:

$$x\ Na_2O,\ Y\ Al_2O_3,\ zSiO_2,\ wH_2O$$

are produced in which if $y=1$, $x=1$, $z=1.8$ to 2 and $w=0$ to 5 and which have a particle size distribution corresponding to the following numerical distribution: 95%<10 μm, 99%<15 μm, 50% ranging from 2 to 6 μm in average diameter.

The suspensions can have a variable zeolite concentration, depending on the intended application thereof. For detergency applications, this concentration typically ranges from 40% to 51%.

The pH of the suspensions also depends on the intended application thereof. Also for detergency applications, this pH, expressed at 1% by weight of dry zeolite, is about 11.

According to the primary characteristic of the present invention, a succinoglycan stabilizing agent is incorporated into the zeolite suspensions described above.

By reason of such stabilizing agent, suspensions are produced which, after storing for several days, do not settle, or which have at most a slight sediment that is easy to resuspend.

By "succinoglycan" are intended the polysaccharides containing succinic acid and galactose and glucose as sugar moieties.

The succinoglycans are typically produced by fermentation of a mixture containing at least one source of carbon which can be assimilated by a strain, or a recombinant or a mutant of such strain, of the types indicated below:

(i) *Pseudomonas*, in particular of NCIB 11592 origin;

(ii) *Rhizobium meliloti*, in particular of U-27, 1021, SU-27, SU-4, SU-231, SU-255, SU-256, K 24 (R 13), A 148 (R 15) or J 7017 origin;

(iii) *Rhizobium trifolii*, in particular of J-60W origin;

(iv) *Alcaligenes faecalis* of myxogenic varieties, in particular of 10C3, 22-33 origin;

(v) *Agrobacterium radiobacter*, in particular of IFO 13533 origin;

(vi) *Agrobacterium rhizogenes*, in particular of IFO 13259 origin;

(vii) *Agrobacterium tumefaciens*, in particular of IFO 3058, A-8 or A-10 origin.

Preferably, a succinoglycan is selected from among those which, after having passed the transition temperature, have an intrinsic viscosity of at least 14,000 ml/g and more particularly of at least 15,000 ml/g.

This intrinsic viscosity is determined by extrapolation to zero concentration of the reduced specific viscosity curve.

According to the present invention, a particularly preferred class of succinoglycans is that produced from an *Agrobacterium tumefaciens* I-736 strain, one of its recombinants or one of its mutants.

Such *Agrobacterium tumefaciens* strain has been deposited in accordance with the Treaty of Budapest with the Collection Nationale de Culture des Microorganismes (CNCM), [National Collection of Microorganism Cultures] on Mar. 1, 1988, where it is accessible to the public under No. 1736. This strain is from the Collection Nationale de Bactéries Phytophathogéne [National Collection of Phytopathogenic Bacteria] and is catalogued under the number CNBP 291 in the 1974 catalog of the organism curator.

The pure *Agrobacterium tumefaciens* I-736 culture can be produced in an inclined gelose tube (slant) incubated at a temperature ranging from 26° to 32° C. and more particularly from 28° to 32° C.

At these temperatures and in particular on media based on MY agar and Bennett agar, the compositions of which are indicated below, the formation of a bacterial mucoid mat covering all of the slant after 20 hours has been observed.

The following maintenance media are considered to be particularly advantageous for the culture of *Agrobacterium tumefaciens* I-736:

| | |
|---|---|
| (a) MY agar medium (in g/l) | |
| Soya peptones | 5 |
| Yeast extract | 3 |
| Malt extract | 3 |
| Glucose | 10 |
| Agar | 20 |
| (b) T G Y agar medium (produced by the Pasteur Institute) (in g/l) | |
| Peptones | 5 |
| Yeast extract | 2.5 |
| Glucose | 1 |
| Agar | 20 |
| (c) Bennett agar medium (in g/l) | |
| Peptones | 1 |
| Meat extract | 1 |
| NZ Amine A ® (produced by Sheffield Chemical) | 2 |
| Glucose | 10 |
| Agar | 20 |
| (d) T.S agar medium (produced by (Bio-Merieux) (in g/l) | |
| Biotrypcase | 17 |
| Biosoyase | 3 |
| $K_2HPO_4$ | 2.5 |
| NaCl | 5 |

-continued

| | |
|---|---|
| Glucose | 2.5 |
| Agar | 20 |

The *Agrobacterium tumefaciens* I-736 strain can also be cultured in a Petri dish, for example, on MY agar or TGY agar medium.

Under these conditions, the colonies are visible after 24 to 30 hours and have the following characteristics at 48 hours:

Size: 2 to 3 mm in diameter

Smooth appearance with little bulging

Very light brown-yellow color

Colonies clean on the sides and less mucoid on the Petri dish than on the slant.

The *Agrobacterium tumefaciens* I-736 strain can assimilate the following sugars:

(i) glucose (ii) sucrose (iii) hydrolyzed starch and, if appropriate, natural starch and lactose.

Glucose and sucrose are the preferred sugars.

It has also been shown that, in general, the succinoglycan produced from this strain contains units derived from glucose, galactose and pyruvic, succinic and acetic acids or the salts of these acids, generally in the respective molar proportions of 5–8/1–2/0.5–2/0.05–2, preferably of 6–7.5/1–1.15/0.5–1/0.5–1/0.05–0.2 and even more preferably of 7/1/0.5–1/0.5–1/0.05–0.1.

Such pyruvic, succinic and acetic acids are typically in the form of salts, such as the sodium, potassium, calcium or ammonium salts.

The principle of the techniques for the analysis of the succinoglycan which has permitted its empirical formula to be determined as specified above is the determination of the constituent elements (sugars and acids) after hydrolysis of the succinoglycan and chromatographic determinations using internal or external standards.

Thus, the determination of the sugars was carried out in the following manner:

100 mg of succinoglycan are hydrolyzed in hermetically sealed tubes by 5 ml of molar trifluoroacetic acid at 105° C. for three to six hours.

This operation is followed by the evaporation to dryness and taking up the dry residue in 5 ml of pyridine containing 15 mg of sorbitol as internal standard; then, a silylation of 1 ml of the pyridine solution by 0.9 ml of hexamethyldisilazane. The silylation is catalyzed by 0.1 ml of trifluoroacetic acid.

The determination of the sugars is then carried out by gas phase chromatography using F.I.D. detection, on a glass capillary column 25 mm long and 0.25 mm in diameter, charged with methylsilicone phase having a film thickness of 0.14μ. The carrier gas used is hydrogen, with a flow rate of 2 ml/minute.

The determination of pyruvic acid is carried out using a mother solution obtained by hydrolysis of 80 mg of succinoglycan by means of 5 ml of 4N hydrochloric acid for 1 hour at 105° C., followed by the addition of 2 mg of ketoglutaric acid (constituting the internal standard) and adjustment to 25 ml with distilled water.

The determination is then carried out by high performance liquid chromatography (HPLC) using a column charged with $C_{18}$ graft silica 5μ in diameter, the length of which is 250 mm and the diameter 4.6 mm. The eluant used is a 50/50 mixture by volume of 0.02M phosphoric acid and acetonitrile. The flow rate is 1.5 ml/minute.

The pyruvic acid is detected by ultraviolet light at 375 nm.

The determination of succinic acid is carried out after hydrolysis of the succinoglycan under the same conditions as those used for the determination of pyruvic acid. The determination is direct, using an external standard. The standard solution of succinic acid used contains 8 mg of succinic acid in 25 ml of water.

The HPLC technique is again used on Aminex HPX87H® columns from BIORAD®. The eluant is 0.01 N sulfuric acid and the flow rate is 0.8 ml/minute. Succinic acid is detected by refractometry.

The determination of acetic acid is carried out after hydrolysis of 300 to 350 mg of the succinoglycan by 5 ml of 4 N trifluoroacetic acid at 120° C. for three hours. 30 mg of propionic acid are then added as internal standard and the determination is carried out by gas phase chromatography using F.I.D. detection.

A glass column 2 m long and 3 mm in diameter filled with 5% FFAP phase and 1% phosphoric acid absorbed on 80 to 100 meash chromosorb G® (AW DMCS) is used for the determination. The carrier gas is helium with a flow rate of 30 ml/minute.

The succinoglycans of the class described above generally also have the following properties:

1. Their intrinsic viscosity ranges from 3,000 to 25,000 ml/g, preferably from 14,000 to 25,000 ml/g and more preferably from 15,000 to 24,000 ml/g.

The intrinsic viscosity ($\eta$) as specified is determined by extrapolation to zero concentration of the reduced viscosity $$\frac{\eta - \eta o}{\eta o C},$$

in which formula:

$\eta$ is the viscosity of the solution at the Newtonian plateau, $\eta o$ is the viscosity of the solvent, C is the succinoglycan concentration, using the Huggins equation:

$$\frac{\eta - \eta o}{\eta o C} = [\eta] + k' [\eta]^2 \cdot C$$

k' being the Huggins constant at the first Newtonian plateau.

The specific viscosity $$\frac{\eta - \eta o}{\eta o}$$

is measured in the following manner:

A mother solution containing 0.2 g/l of succinoglycan in an aqueous 0.1M NaCl solution is prepared.

A range of solutions containing the succinoglycan at concentrations ranging from 0.03 to 0.1 g/l is then prepared by dilution of the mother solution with the aqueous 0. 1 NaCl solution.

The measurements are then carried out at 23° C. using a low shear viscometer.

The specific viscosity curve is plotted as a function of the concentration and extrapolated to zero concentration.

2. The molecular weights of these succinoglycans, measured by light diffusion, generally range from $6\times10^6$ to $10\times10^6$ and preferably from $6.5\times10^6$ to $9.5\times10^6$.

3. These succinoglycans also have very good rheological properties in solution in distilled water and, in particular, have these properties at low concentrations.

Thus, solutions containing 0.1% by weight of a succinoglycan of this type in distilled water at 25° C. have viscosities at 24 hours of more than 400 mPa.s and more particularly ranging from 400 to 700 mPa.s; the viscosities are measured at a velocity gradient of 1 $s^{-1}$ using a low shear viscometer.

Similarly, aqueous solutions containing 0.2% by weight of one of these succinoglycans, at pH 1.7 and at 25° C., have a viscosity at 24 hours ranging from 1,000 to 2,500 mPa.s, and more particularly from 1,400 to 2,000 mPa.s, the viscosities being measured using a low shear viscometer at a velocity gradient of 1 $s^{-1}$.

Finally, 0.2% by weight solutions of the same succinoglycans in distilled water, subjected to a temperature of 80° C. for 24 hours, generally have viscosities ranging from 500 to 2,500 mPa.s and more particularly from 1,000 to 2,000 mPa.s, the viscosities being measured using a low shear viscometer at a velocity gradient of 1 $s^{-1}$.

The succinoglycans produced from the *Agrobacterium tumefaciens* I-736 strain can be prepared by a process more fully described below.

As indicated above, these succinoglycans are produced by fermentation of a medium containing at least one source of assimilable carbon by the above-mentioned strain.

The medium is inoculated in conventional manner with the *Agrobacterium tumefaciens* I-736 strain.

If the volume of the fermentation medium is large, it can be advantageous to inoculate it using an inoculum medium seeded by a medium of liquid preculture; the later is itself seeded before hand by a pure culture of *Agrobacterium tumefaciens* I-736.

The inoculum medium used can be any medium conventionally employed for this purpose and advantageously a medium of inorganic nature. An example of a preculture medium which is representative is the YM bioth DIFCO Ref. 07101 medium and preferably a medium prepared from the following constituents:

| | |
|---|---|
| (i) Soya peptones | 5 g/l |
| (ii) Malt extract | 3 g/l |
| (iii) Yeast extract | 3 g/l |
| (iv) Glucose or sucrose | 10 g/l. |

The natural pH of this medium is 7 to 7.2 and is not adjusted.

Sugars such as glucose, sucrose, hydrolyzed starch and, optionally, lactose or naturally occurring starch, as well as the mixtures of these sugars, are exemplary organic sources of carbon which is a constituent of the fermentation medium. Glucose and sucrose are preferred sugars. The concentration of the organic source of carbon in the fermentation medium can range from 1 to 100 g/l and preferably from 15 to 60 g/l.

Other than said source of assimilable carbon, the fermentation medium may also contain at least one source of nitrogen, preferably an organic source of nitrogen, and, optionally, one or more inorganic salts.

Casein and the caseinates, hydrolyzed fish products, wheat, maize or soya flours, yeast extracts (bakers yeast, brewers yeast, lactic yeasts, etc.), soluble dry distillers, potato proteins, corn steap liquor (CSL) and the solubles of CSL which are obtained by dilution of CSL followed by removal of the solid particles by centrifuging, clarifying or settling, are exemplary organic sources of nitrogen. CSL and very particularly the solubles of CSL are particularly preferred embodiments of the present invention.

The concentration of the organic nitrogen source in the fermentation medium advantageously ranges from 3 to 80 g/l and preferably from 5 to 50 g/l.

Sulfates, such as magnesium, manganese, zinc or iron sulfates, carbonates, such as calcium carbonate, soluble calcium salts and phosphates, such as potassium or sodium phosphates, are exemplary inorganic salts which may optionally be introduced into the fermentation medium.

The concentration of each of these inorganic salts in the fermentation medium advantageously ranges from 0.01 to 5 g/l and preferably from 0.05 to 2 g/l.

The fermentation medium can also contain oligo elements such as traces of cobalt salts and/or molybdenum salts, as well as vitamins and nucleotides.

The fermentation is advantageously carried out at pressures ranging from 1 to 4 bars at a temperature ranging from 25° to 35° C., and preferably from 28° to 32° C., under submerged aerobic conditions.

The pH of the fermentation medium advantageously ranges from 5 to 9 and preferably from 6 to 8. The pH can be adjusted, depending on the particular case, using a base such as sodium hydroxide solution or potassium hydroxide solution, or using an acid such as sulfuric acid, phosphoric acid, hydrochloric acid or nitric acid. The fermentation tank or vessel, is advantageously subjected to agitation.

This agitation can be exerted, for example, by means of a reciprocal shaker, a gyratory shaker, a moving stirrer or a bubble column. The fermentation time is usually longer than 30 hours but generally ranges from 40 to 90 hours.

The fermentation yields are generally more than 40%, more particularly range from 55 to 75% and very preferably from 60 to 75% by weight of succinoglycan produced relative to the source of carbon employed.

The succinoglycan can be separated from the fermentation medium.

To accomplish this, the fermentation wort containing the succinoglycan is advantageously heated to temperatures of from 80° to 120° C. for 10 to 60 minutes and preferably from 15 to 45 minutes.

The wort subjected to the above heat treatment advantageously has a pH ranging from 6 to 8.

However, this pH can be adjusted, if necessary, using a base or an acid depending on the particular case.

Such bases and acids can be selected from among the above-mentioned bases and acids used to adjust the pH of the fermentation medium.

The recovery of the succinoglycan from the wort upon completion of fermentation can then be carried out by precipitation of said succinoglycan using an organic liquid miscible with water and in which the succinoglycan is insoluble or virtually insoluble.

Acetone and alcohols, such as ethanol, propanol, isopropanol, butanol or tert.-butanol, are exemplary such organic liquids.

Isopropanol is more particularly preferred according to the present invention.

The volume of organic liquid used is generally 2 to 3 times that of the volume of the wort to be treated.

The precipitation of the succinoglycan by an organic liquid can also be carried out in the presence of salts such as sodium sulfates, chlorides or phosphates, potassium sulfates, chlorides or phosphates or calcium sulfates, chlorides or phosphates.

Once precipitated, the succinoglycan can then be separated from the organic liquid by filtration, centrifuging or draining.

The fibers obtained can be dehydrated, for example, using acetone or an alcohol such as ethanol, propanol, isopropanol or tert.-butanol.

The weight of alcohol necessary to effect this dehydration operation generally ranges from 1 to 10 times that of the fibers to be treated.

The dehydrated fibers can be subjected to fresh filtration, centrifugation or draining operations.

The fibers can then be dried, ground and screened so as to obtain a powder.

In order to obtain an even purer powder, it is possible to treat either the fermentation wort or an aqueous solution reconstituted from the powder obtained by the process described above using one or more enzymes.

Proteases, mutanases, lipoproteases, cellulases and chitinases are exemplary enzymes which are suitable for this purpose.

The enzymatic purification can be combined with or replaced by physical purification processes, such as the various techniques of filtration or dialysis, or the various chromatographic techniques.

The fermentation worts and the reconstituted aqueous solutions of succinoglycan, which may or may not have been subjected to a purification treatment, can be concentrated. Concentration can be advantageous in some cases, in particular insofar as transport costs can be reduced by this means. The concentration can be effected by techniques such as evaporation or ultrafiltration, or by diafiltration.

According to the present invention, the succinoglycans are used in solid form as a powder, or as an aqueous solution.

Generally, from 0.001 to 2% weight and preferably from 0.01 to 0.5% by weight of succinoglycan are used relative to the suspension.

The suspensions of the invention containing a succinoglycan as described above are particularly stable.

However, in order to reduce their viscosity and, on a practical scale, to render them more easily handleable and more pumpable, it is also possible to incorporate a dispersing agent therein.

In a preferred embodiment of the invention, this dispersing agent is a siliconate and/or a siliconate derivative.

The siliconates are compounds well known to this art and include the salts of siliconic acid or derivatives thereof.

Particularly representative siliconates are those having the formula (I)L $$R-Si(OM)_m(OH)_{3-m} \quad (I)$$

and/or the condensation products thereof, in which formula R is a hydrocarbon radical advantageously having from 1 to 18 carbon atoms or a substituted such hydrocarbon radical bearing a halogen atom or an amino, ether, ester, epoxy, mercapto, cyano or (poly)-glycol group; m is an integer or fraction ranging from 0.1 to 3; and M is an alkali metal or an ammonium or phosphonium group.

Preferably, R is a hydrocarbon radical having from 1 to 10 carbon atoms and more preferably from 1 to 6 atoms.

In particular, R can be an alkyl radical, for example, methyl, ethyl, propyl, butyl or isobutyl; an alkenyl radical, such as, for example, vinyl; an aryl radical, for example, phenyl or naphthyl; and arylalkyl radical, such as, for example, benzyl or phenethyl; an alkylaryl radical, such as for example, tolyl or xylyl; or an araryl radical, such as biphenylyl.

Exemplary of M, sodium or potassium are particularly representative, as are the groups $N^+R'_4$ and $P^+R'_4$ in which the radicals R', which may be identical or different, are each a hydrocarbon radical having from 1 to 6 carbon atoms.

The alkali metal siliconates are more preferably used. It is also possible to use the alkaline earth metal siliconates.

Similarly, the alkylsiliconates and especially the alkali metal alkylsiliconates such as, for example, the sodium or potassium methylsiliconates, are also preferred.

It is also possible to use the siliconates of formula (I) in which R is a vinyl or phenyl radical, and more particularly the alkali metal siliconates thereof.

It will be appreciated that the alkali metal or alkaline earth metal siliconates are compounds that are available commercially.

They can be prepared, for example, by hydrolysis of the corresponding silanes having 3 hydrolyzable groups such as halogen atoms or alkoxy radicals, followed by a dissolution of the resulting product in a solution of a strong inorganic base, in proportions such that there is at least one equivalent of base per silicon atom (see, for example, U.S. Pat. Nos. 2,441,422 and 2,441,423).

Exemplary siliconates of this type which are available commercially are, in particular, RHODORSIL® SILICONATE 51T, marketed by the assignee hereof, which is a potassium methylsiliconate.

As indicated above, the dispersing agent can also be a derivative of a siliconate.

By "derivative(s)" are intended the condensation products of compounds corresponding in particular to the above formula (I), or those resulting from the at least partial polymerization of such compounds into silicon compounds or polymers.

It is known to the art, for example, that the alkali metal alkylsiliconates can be converted into polyalkylsiloxanes, in particular by the action of carbon dioxide or another acidifying agent.

In another preferred embodiment of the invention, the dispersing agent is a silicone resin.

These silicone resins are branched organopolysiloxane polymers which are well known to this art and are available commercially. They comprise, per molecule, at least two different structural units selected from among those of the formulae $R_3SiO_{0.5}$ (unit M), $R_2SiO$ (unit D), $RSiO_{1.5}$ (unit T) and $SiO_2$ (unit Q).

The radicals R are identical or different and are each a straight or branched chain alkyl radical, preferably having from 1 to 6 carbon atoms, or a vinyl, phenyl or 3,3,3-trifluoropropyl radical.

More particularly representative alkyl radicals R are the methyl, ethyl, isopropyl, tert.-butyl and n-hexyl radicals.

These resins are preferably hydroxylated and in this event have a hydroxyl group content by weight ranging from 0.1 to 10%.

Exemplary such resins are the MQ resins, the MDQ resins, the TD resins and the MDT resins.

It is particularly advantageous to incorporate resins having a molecular weight of less than 25,000.

In particular, the products marketed by the assignee hereof under the trademarks RHODORSIL 865 A or 878 A are exemplary resins of this type.

It will of course be appreciated that any two or more siliconates, siliconate derivatives or silicone resins may be used in combination in the zeolite suspensions of this invention.

The siliconates are typically used in the form of aqueous solutions.

The amount of siliconate incorporated is a function of the specific surface area of the zeolite. This amount advantageously ranges from 0.01 to 2%, more preferably from 0.05 to 0.3% by weight relative to the suspension. This amount applies for a 50% solution of the siliconate or siliconate derivative in water.

The resins can be used in the solid state, or in the form of aqueous emulsions, or of emulsions or solutions in an organic solvent.

The amount of resin incorporated advantageously ranges from 0.01 to 2% by weight of total solids, more particularly ranging from 0.05 to 0.3% relative to the suspension.

As indicated above, the effect of incorporation of the siliconate derivatives and silicone resins is to lower the viscosity of the zeolite suspensions considerably. It also enables stable suspensions to be produced having a higher solids content, for example, of at least 55%.

Also according to the present invention, the known dispersing agents can be used. In this event also, these dispersing agents can be used either alone or in combination, and even in combination with the siliconates, the siliconate derivatives or the silicone resins.

Such dispersing agents are advantageously nonionic or anionic surfactants, macromolecular organic polymer compounds bearing carboxyl and/or hydroxyl groups and phosphates.

Exemplary nonionic surfactants include the compounds produced by a condensation reaction of an alkylene oxide with an organic compound which can be aliphatic or alkyl-aromatic.

The polyoxyethylenated alkylphenols, the polyoxyethylenated aliphatic alcohols, the carboxylic amides and the polyoxyethylenated and polyoxypropylenated alcohols, in particular of the "PLURONICS" type, are particularly representative.

The ethoxylated tristyrylphenol and ethoxylated nonylphenol are also exemplary.

Finally, the surfactants of sucroglyceride type are also suitable.

Anionic surfactants which are exemplary are the alkali metal soaps, the alkali metal sulfonates, such as the methylnaphthalenesulfonate or the xylenesulfonate, the betasulfoethyl esters of fatty acids, sulfates and sulfated compounds, such as alkyl sulfates and polyoxyethylenated and sulfated fatty alcohols.

Exemplary macromolecular organic polymer compounds are the polymers of acrylic, hydroxyacrylic, maleic and itaconic acids, and the copolymers of the above-mentioned acids with one another or with ethylenically unsaturated compounds such as ethylene, propylene, vinyl alcohol, vinyl acetate or methacrylic acid. Compare in this respect the polymers described in FR-A-2,287,504.

Finally, with regard to the phosphates, these may be selected from among the primary or secondary esters of orthophosphoric acid or one of its salts and monoesters or diesters of such acid or its polyoxyethylenated salts. Inorganic phosphates, in particular alkali metal phosphates such as sodium pyrophosphate, sodium tripolyphosphate or sodium hexametaphosphate, are also exemplary.

It should be appreciated that it is possible to add a bactericidal agent to the suspensions of the invention.

The preparation of the zeolite suspensions according to the invention is carried out in a simple manner by introducing the additives described above into the suspension and mixing. If necessary, the pH of the zeolite suspensions can be adjusted to the desired value in known manner by adding any suitable neutralizing agent.

The suspensions containing the zeolites and stabilized by the systems described above are useful in numerous applications.

They can be used in the form of suspensions essentially based on zeolites and the stabilizing additives described above. In this case, they can be used in the preparation of detergent compositions. They can be used in any field other than detergency in which zeolites are employed, for example, in papermaking.

The present invention also features novel detergent compositions, in particular liquid detergents, which in addition to the suspensions based on zeolites and the stabilizers, also contain all of the other additives typically included in detergency applications, such as bleaching agents, foamcontrol agents, anti-soil agents, perfumes, solvents, enzymes and brighteners.

In order to further illustrate the present invention and the advantages thereof, the following spacific examples are given, it being understood that same are intended only as illustrative and in nowise limitative.

EXAMPLES

In these Examples, the suspensions were formulated as described above and the immediate following definitions and processing parameters were employed.

The solids content of the suspension is reported as a percentage by weight of anhydrous zeolite determined by measuring the weight loss on heating at 850° C. for one hour.

The pH indicated is reported for an aqueous dispersion containing 1% of dry zeolite and it was measured using a high alkalinity pH electrode.

The exchange capacity as reported by the amount of calcium (expressed as mg of $CaCO_3$) exchanged by 1g of anhydrous zeolite at 25° C. The measurement was carried out in the following manner: 0.4 g of zeolite (expressed as anhydrous zeolite) was introduced into a $5\times10^{-3}$ mol/l solution of $CaCl_2$. The mixture was stirred for 15 minutes. After filtering, the excess calcium was determined at pH 10 by back titration against EDTA in the presence of a colored indicator, Eriochrome Black T.

It should be appreciated that the stabilizer/dispersing agent system of the invention did not disturb or alter this capacity.

With regard tot he rheology, the rheometer used was RHEOMAT 30 fitted with a centered B measurement system. The measurement entailed observing a velocity gradient cycle (ascending and descending). The range of velocity gradient investigated ranged from 0.0215 to 157.9 $s^{-1}$, which corresponded to speeds of rotation of the moving body of 0.0476 to 350 revolutions per minute. The viscosities reported below correspond to the measurements obtained during the descent of the velocity gradient.

The sedimentation was determined by introducing the zeolite suspension into 50 to 100 cc graduated cylinders. The volumes of supernatant and settled material were measured every five days. The cylinders were maintained at ambient temperature (20° C.) or placed in a thermostat-controlled chamber.

The zeolite used was a 4A zeolite having an average diameter of the primary particles of 3.5 μm.

Succinoglycan stabilizer

The succinoglycan used in the Examples which follow was prepared in the following manner:

| | |
|---|---|
| CSL (corn steap liquor) | 11 |
| $K_2HPO_4$ | 4 |
| $MgSO_4 \cdot 7H_2O$ | 0.5 |
| sucrose | 25 |
| potable water q.s. | 1.1 |

was fermented with an *Agrobacterium tumefaciens* I-736 strain.

This medium was fermented with said strain at a temperature of 28° C. in a 20 liter BIOLAFFITE® tank containing a useful volume of 15 liters.

The medium was subjected to stirring at 400 revolutions/min obtained using stirrers of the RUSHTON® type.

The medium was aerated using an airflow of 825 l/h.

At the end of the fermentation, the recovery of the succinoglycan was carried out from 2 kg of wort.

The wort was subjected to a heat treatment at 90° C. for 30 min.

2,300 ml of isopropyl alcohol (IPA) were added to the wort thus treated. Precipitation was carried out in the presence of 150 g of sodium sulfate.

The fibers obtained from the precipitation were then dehydrated twice int eh presence of 1,200 ml of IPA.

The fibers were then drained, dilacerated and dried in an over at 85° C.

The dry material collected was ground and screened.

EXAMPLES 1 to 3

These Examples relate to the stabilization of zeolite suspensions by the succinoglycan.

The suspension contained 45% by weight of zeolite.

The results are reported in Table I below:

TABLE I

| Example | 1 | | 2 | 3 (Comparative) | |
|---|---|---|---|---|---|
| Succinoglycan % by weight relative to the suspension | 0.1 | | 0.05 | 0 | |
| pH | 11.48 | | 11.48 | 11.52 | |
| Sedimentation | | | | | |
| Supernatant | | | | | |
| % by volume | 20° C. | 50° C. | 20° C. | 20° C. | 50° C. |
| 5 days | 0 | 2 | <1 | 16 | 21 |
| 10 days | <1 | 2 | 2.5 | 18 | 23 |
| 15 days | 1 | 2 | 3 | 20 | 23 |
| Settle material | | | | | |
| % by volume | | | | | |
| 5 days | 0 | 0 | 0 | 60 | 60 |
| 10 days | 0 | 0 | 0 | 60 | 77 |
| 15 days | 0 | 0 | <<1 | 80 | 77 |

EXAMPLES 4 to 7

The results are reported in Table II below.

With regard to RHODORSIL 51 T, the amounts indicated are in percentages by weight for a 50% aqueous solution of siliconate.

The resin A was a resin as described above, in which R was a methyl radical. This resin was used int eh dry or solid state. It is marketed by the assignee hereof int he form of an emulsion, under the trademark RHODORSIL 865 A.

TABLE II

| Example | 4 | 5 | 6 | 7 (Comparative) |
|---|---|---|---|---|
| Suspension % of anhydrous zeolite | 48.8 | 49.9 | 49.2 | 49.7 |
| Exchange capacity | 291 | 297 | 274 | 323 |
| Succinoglycan % by weight relative to the suspension | 0.08 | 0.08 | 0.12 | 0 |
| Dispersing agent % by weight relative to the suspension | Rhodorsil Siliconate 51T 0.17 | Rhodorsil Siliconate 51T 0.21 | resin A 0.2 | 0 |
| pH of the the suspension | 10.87 | 10.44 | 11.48 | 11.57 |
| Rheology Viscosity (poises) | | | | |
| at 4.74 $s^{-1}$ | 11 | 15.4 | 14.4 | 59.2 |
| at 32 $s^{-1}$ | 6.3 | 6.6 | 6.6 | |
| Sedimentation Supernatant in % of the volume | | | | |
| 5 days | 1 | 0 | 0 | 3.5 |
| 10 days | 2 | 0.5 | 0 | |
| 15 days | 2 | 1 | 1 | |
| Settled material in % of the volume | | | | |
| 5 days | 0 | 0 | 0 | 60 |
| 10 days | <1 | <<1 | 0 | |
| 15 days | 1 | 1 | <<1 | |

EXAMPLES 8 and 9

Example 8 relates to the use of a small amount of succinoglycan.

In Example 9 a "Resin B" resin was used, such resin being described above in which R was a methyl radical.

This resin was used in the dry state. I tis marketed by the assignee hereof int he form of an emulsion, under the trademark RHODORSIL 878 A.

The results are reported in Table III below:

TABLE III

| Example | 8 | 9 |
|---|---|---|
| Suspension % of anhydrous zeolite | 49.6 | 49.3 |
| Exchange capacity | | 295 |
| Succinoglycan in % by weight relative to the suspension | 0.02 | 0.12 |
| Dispersing agent | Siliconate | Resin B |
| % by weight relative to the suspension | 0.2 | 0.2 |
| pH of the suspension | 10.67 | 11.49 |
| Rheology Viscosity (poises) | | |
| at 4.74 $s^{-1}$ | 13.3 | 14 |
| at 32 $s^{-1}$ | 6.9 | 12.6 |
| Sedimentation Supernatant in % of the volume | | |
| 5 days | 1 | 5 |
| 10 days | | 5 |
| 15 days | 2 | 5 |

EXAMPLES 10 to 14

Example 10 relates to the use of a non-ionic surfactant of the sucroglyceride type, marketed by the assignee hereof under the trademark CELYNOL X8063 as a dispersing agent.

Example 11 relates to the use of a non-ionic surfactant of the ethoxylated tristyrylphenol type marketed under the trademark SOPROPHOR S25 by the assignee hereof, as a dispersing agent.

Example 12 relates to a dispersing agent of the anionic surfactant type which was a phosphated ethoxylated tristyrylphenol marketed under the trademark SOPROPHOR FL by the assignee hereof.

Examples 13 to 14 relate to acrylic polymers. Polymer 1 was an acrylic homopolymer having molecular weight of 2,000. Polymer 2 was an acrylic/maleic copolymer having a molecular weight of 70,000 and an acrylic/maleic ratio of 60/40.

The results are reported in Table IV below:

TABLE IV

| Example | 10 | 11 | 12 | 13 | 14 |
|---|---|---|---|---|---|
| Suspension % of anhydrous zeolite | 49.3 | 49.3 | 49.3 | 49.3 | 49.3 |
| Succinoglycan in % by weight relative to the suspension | 0.04 | 0.04 | 0.04 | 0.08 | 0.08 |
| Dispersing agent % by weight relative to the suspension | CELANOL 0.2 | SOPROPHOR S25 0.2 | SOPROPHOR FL 0.2 | POLYMER 1 0.2 | POLYMER 2 0.2 |
| pH of the suspension | 11.6 | 11.6 | 11.6 | 11.6 | 11.6 |
| Sedimentation Supernatant in % of the volume | | | | | |
| 5 days | 0 | 0 | 0 | 0 | 0 |
| 10 days | | | | | |
| 15 days | | | | | |
| Settled material | | | | | |

TABLE IV-continued

| Example | 10 | 11 | 12 | 13 | 14 |
|---|---|---|---|---|---|
| in % of the volume | | | | | |
| 5 days | 0 | 0 | 0 | 0 | 0 |
| 10 days | | | | | |
| 15 days | | | | | |

While the invention has been described in terms of various preferred embodiments, the skilled artisan will appreciate that various modifications, substitutions, omissions, and charges may be made without departing from the spirit thereof. Accordingly, it is intended that the scope of the present invention be limited solely by the scope of the following claims, including equivalents thereof.

What is claimed is:

1. A stable suspension of zeolite particulates, in water, said zeolite suspension having a pumpable viscosity and comprising an effective stabilizing amount of a succinoglycan.

2. The stable zeolite suspension as defined by claim 1, said succinoglycan having been produced by fermentation of a medium containing at least one source of assimilable carbon by a strain of *Pseudomonas, Rhizobium meliloti, Rhizobium trifoli, Alcaligenes faecalis, Agrobacterium radiobacter, Agrobacterium rhizogenes, Agrobacterium tumefaciens*, or recombinant or mutant thereof.

3. The stable zeolite suspension as defined by claim 1, said succinoglycan having an intrinsic viscosity of at least 14,000 ml/g.

4. The stable zeolite suspension as defined by claim 2, said succinoglycan having been produced by an *Agrobacterium tumefaciens* I-736 strain, or recombinant or mutant thereof.

5. The stable zeolite suspension as defined by claim 4, said succinoglycan having an intrinsic viscosity ranging from 14,000 ml/g to 25,000 ml/g.

6. The stable zeolite suspension as defined by claim 4, a 0.1% by weight solution of said succinoglycan in distilled water at 25° C. having a viscosity after 24 hours in excess of 350 mPa.s.

7. The stable zeolite suspension as defined by claim 4, a 0.2% by weight aqueous solution of said succinoglycan at a pH of 1.7 and at 25° C. having a viscosity after 24 hours ranging from 1,000 to 2,500 mPa.s.

8. The stable zeolite suspension as defined by claim 4, a 0.2% solution of said succinoglycan in distilled water, subjected to a temperature of 80° C. for 24 hours, having a viscosity ranging from 500 to 2,500 mPa.s.

9. The stable zeolite suspension as defined by claim 4, said succinoglycan comprising structural units derived from glucose, galactose and pyruvic, succinic and acetic acids or salts of such acids in the respective molar proportions of 5-8/1-2/0.5-2/0.5-2/0.05-2.

10. The stable zeolite suspension as defined by claim 9, said respective molar proportions being 6-7.5-/1-1.5/0.5-1/0.5-1/0.05-0.2.

11. The stable zeolite suspension as defined by claim 9, said respective molar proportions being 7/1/0.5-1/0-.5-1/0.05-0.1.

12. The stable zeolite suspension as defined by claim 4, said succinoglycan having been produced by fermentation of a medium comprising glucose, sucrose or a hydrolyzed starch as a source of assimilable carbon.

13. The stable zeolite suspension as defined by claim 12, having been produced by fermentation of a medium further comprising an organic source of nitrogen.

14. The stable zeolite suspension as defined by claim 13, said organic source of nitrogen comprising casein or a caseinate, wheat, maize or soya flour, a yeast extract, soluble dry distillers, a potato protein, a corn steap liquor or a soluble fraction of corn steap liquor.

15. The stable zeolite suspension as defined by claim 1, further comprising an effective amount of a dispersing agent.

16. The stable zeolite suspension as defined by claim 15, said dispersing agent comprising a siliconate and/or a siliconate derivative.

17. The stable zeolite suspension as defined by claim 15, said dispersing agent comprising a silicone resin.

18. The stable zeolite suspension as defined by claim 15, said dispersing agent comprising a non-ionic or anionic surfactant, a macromolecular organic polymer or carboxylated and/or hydroxylated such polymer, or a phosphate.

19. The stable zeolite suspension as defined by claim 3, said succinoglycan having an intrinsic viscosity of at least 15,000 ml/g.

20. The stable zeolite suspension as defined by claim 6, such aqueous solution having a viscosity ranging from 400 to 700 mPa.s.

21. The stable zeolite suspension as defined by claim 7, such aqueous solution having a viscosity ranging from 1,400 to 2,000 mPa.s.

22. The stable zeolite suspension as defined by claim 8, such aqueous solution having a viscosity ranging from 1,000 to 2,000 mPa.s.

23. The stable zeolite suspension as defined by claim 1, said zeolite particulates having an average primary particle diameter ranging from 0.1 to 10 μm.

24. The stable zeolite suspension as defined by claim 1, said zeolite particulates having an average primary particle diameter ranging from 0.5 to 5 μm.

25. The stable zeolite suspension as defined by claim 1, comprising zeolite A, X or Y particulates.

26. The stable zeolite suspension as defined by claim 25, comprising zeolite 4A or 13X particulates.

27. The stable zeolite suspension as defined by claim 1, having a zeolite concentration ranging from 40 to 51%.

28. The stable zeolite suspension as defined by claim 17, said silicone resin dispersing agent comprising an organopolysiloxane polymer containing, per molecule, at least two structural units of the formulae $R_3SiO_{0.5}$ (unit M), $R_2SiO$ (unit D), $RSiO_{1.5}$ (unit T) and $SiO_2$ (unit Q), wherein the radicals R, which may be identical or different, are each a straight or branched chain alkyl radical, or a vinyl, phenyl or 3,3,3-trifluoropropyl radical.

29. The stable zeolite suspension as defined by claim 28, said silicone resin comprising a hydroxylated such organopolysiloxane polymer.

30. The stable zeolite suspension as defined by claim 28, said silicone resin comprising an MQ, MDQ, TD or MDT organopolysiloxane polymer.

31. The stable zeolite suspension as defined by claim 28, said silicone resin having a molecular weight of less than 25,000.

32. The stable zeolite suspension as defined by claim 28, comprising from 0.05 to 0.3% by weight of said silicone resin.

33. The stable zeolite suspension as defined by claim 16, said siliconate and/or siliconate derivative having the formula (I):

$$R—Si(OM)_m(OH)_{3-m} \quad (I)$$

and/or a condensation product thereof, in which R is a hydrocarbyl radical having from 1 to 18 carbon atoms, or a substituted such hydrocarbyl radical bearing at least one halogen atom or amino, ether, ester, epoxy, mercapto, cyano or (poly)glycol group; m is a number ranging from 0.1 to 3; and M is an alkali metal or an ammonium or phosphonium group.

34. The stable zeolite suspension as defined by claim 33, wherein formula (I), R is an alkyl radical.

35. The stable zeolite suspension as defined by claim 33, wherein formula (I), R is phenyl or vinyl.

36. The stable zeolite suspension as defined by claim 16, said siliconate and/or siliconate derivative comprising an alkali or alkaline earth metal siliconate.

37. The stable zeolite suspension as defined by claim 16, said siliconate and/or siliconate derivative comprising an alkylsiliconate.

38. The stable zeolite suspension as defined by claim 16, comprising from 0.05 to 0.3% by weight of said siliconate and/or siliconate derivative.

39. A detergent composition comprising the stable zeolite suspension as defined by claim 1.

* * * * *